US009778667B2

(12) United States Patent
Peluso

(10) Patent No.: US 9,778,667 B2
(45) Date of Patent: Oct. 3, 2017

(54) SLOW START FOR LDO REGULATORS

(71) Applicant: QUALCOMM Incorporated, San Deigo, CA (US)

(72) Inventor: Vincenzo F Peluso, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 300 days.

(21) Appl. No.: 13/954,757

(22) Filed: Jul. 30, 2013

(65) Prior Publication Data

US 2015/0035505 A1 Feb. 5, 2015

(51) Int. Cl.

*G05F 1/56* (2006.01)
*G05F 1/575* (2006.01)
*G05F 1/46* (2006.01)

(52) U.S. Cl.

CPC ..... *G05F 1/56* (2013.01); *G05F 1/465* (2013.01); *G05F 1/575* (2013.01); *G05F 1/468* (2013.01)

(58) Field of Classification Search

CPC . G05F 1/56; G05F 1/575; G05F 1/465; G05F 1/468; H02M 2001/0045
USPC ..... 323/273–281, 313
See application file for complete search history.

(56) References Cited

U.S. PATENT DOCUMENTS 6,166,527 A * 12/2000 Dwelley ..... H02M 3/1582 323/222
6,580,257 B2 * 6/2003 Marty ..... 323/280
6,804,102 B2 * 10/2004 Hamon et al. ..... 361/93.3
7,173,405 B2 * 2/2007 Bo et al. ..... 323/312
7,408,332 B2 8/2008 Yee
7,450,354 B2 * 11/2008 Tain et al. ..... 361/18
7,615,977 B2 * 11/2009 Gicquel et al. ..... 323/273
7,772,815 B2 * 8/2010 Okuda ..... G05F 1/56 323/276
7,839,130 B2 * 11/2010 Shimizu ..... H02M 1/32 323/282
7,969,703 B2 * 6/2011 Tanaka ..... G05F 1/573 361/93.7

(Continued)

FOREIGN PATENT DOCUMENTS

CN 102736657 A 10/2012
JP 2009266121 A 11/2009
TW 201316662 A 4/2013

OTHER PUBLICATIONS

International Search Report and Written Opinion—PCT/US2014/047976—ISA/EPO—Nov. 4, 2014.

*Primary Examiner* — Kyle J Moody
(74) *Attorney, Agent, or Firm* — Arent Fox, LLP and Qualcomm

(57) ABSTRACT

Techniques for generating a control voltage for a pass transistor of a linear regulator to avoid in-rush current during a start-up phase. In an aspect, a digital comparator is provided to generate a digital output voltage comparing a function of the regulated output voltage with a reference voltage, e.g., a ramp voltage. The digital output voltage is provided to control a plurality of switches selectively coupling the gate of the pass transistor to one of a plurality of discrete voltage levels, e.g., a bias voltage or a ground voltage to turn the pass transistor on or off. In another aspect, the digital techniques may be selectively enabled during a start-up phase of the regulator, and disabled during a normal operation phase of the regulator.

22 Claims, 10 Drawing Sheets

(56) References Cited

U.S. PATENT DOCUMENTS

| | | | | |
|---|---|---|---|---|
| 8,169,202 | B2 | 5/2012 | Chen | |
| 8,233,257 | B2 * | 7/2012 | Hasegawa | G05F 1/573 361/93.9 |
| 8,436,595 | B2 * | 5/2013 | Simmons | G05F 1/575 323/273 |
| 8,593,120 | B2 * | 11/2013 | Heng | G05F 1/573 323/276 |
| 2005/0116692 | A1 | 6/2005 | Sugiyama | |
| 2007/0216383 | A1 | 9/2007 | Al-Shyoukh et al. | |
| 2011/0057635 | A1 | 3/2011 | Ishikawa | |
| 2012/0113737 | A1 | 5/2012 | Lee et al. | |
| 2013/0049721 | A1 * | 2/2013 | Lo et al. | 323/280 |

* cited by examiner

SLOW START FOR LDO REGULATORS

BACKGROUND

Field

The disclosure relates to techniques to configure a start-up phase for a low drop-out (LDO) voltage regulator.

Background

Low drop-out (LDO) regulators are a type of linear voltage regulator. LDO regulators typically include a pass transistor, an error amplifier, and a resistive feedback divider. During normal operation, the pass transistor supplies current from a power supply to a load to generate a regulated voltage. The error amplifier sets the current supplied by the pass transistor to the load to be a function of the difference between the regulated voltage (as sampled by the resistive feedback divider) and a reference voltage.

In a start-up phase of the LDO regulator, the reference voltage may be brought up gradually over time from zero volts to a target voltage, e.g., the reference voltage may follow a linear ramp profile. This is done to limit undesirable inrush current from the power supply into the load during initial start-up of the LDO regulator, which may undesirably disrupt the power supply level and adversely affect other circuitry coupled to the power supply. Despite such precautions, inrush current may nevertheless be drawn from the power supply in certain scenarios. For example, if a buffer is provided between the error amplifier and the pass transistor, then the initial voltage at the output of the buffer may not be well-defined, thereby potentially causing a transient inrush current.

It would thus be desirable to provide techniques for limiting inrush current during a start-up phase of an LDO regulator.

DETAILED DESCRIPTION

Figure 1:
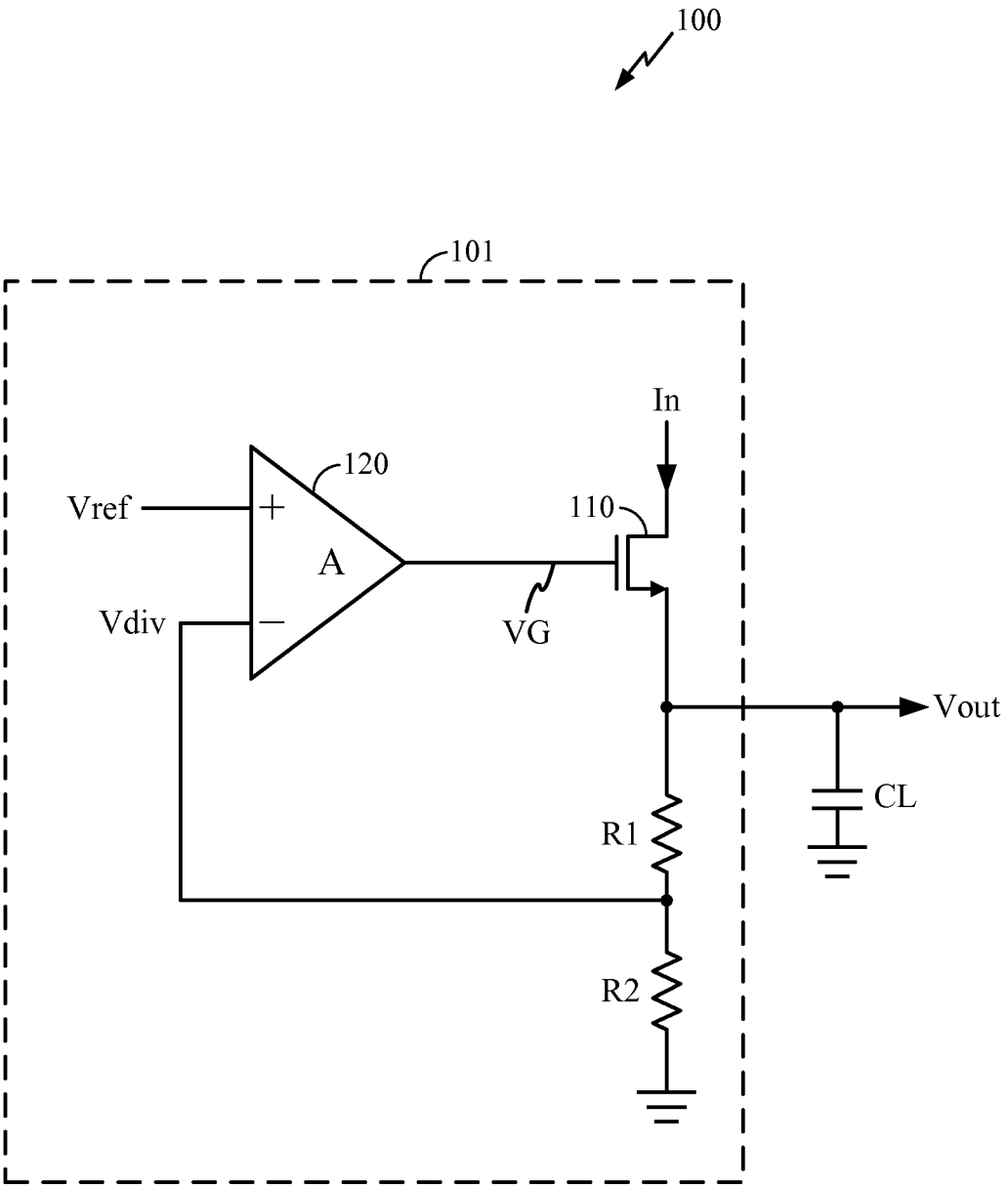
(PRIOR ART) FIG 1
FIG. 1 illustrates a prior art implementation of a low drop-out (LDO) voltage regulator, including start-up circuitry.

Various aspects of the disclosure are described more fully hereinafter with reference to the accompanying drawings.

This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The detailed description set forth below in connection with the appended drawings is intended as a description of exemplary aspects of the invention and is not intended to represent the only exemplary aspects in which the invention can be practiced. The term "exemplary" used throughout this description means "serving as an example, instance, or illustration," and should not necessarily be construed as preferred or advantageous over other exemplary aspects. The detailed description includes specific details for the purpose of providing a thorough understanding of the exemplary aspects of the invention. It will be apparent to those skilled in the art that the exemplary aspects of the invention may be practiced without these specific details. In some instances, well-known structures and devices are shown in block diagram form in order to avoid obscuring the novelty of the exemplary aspects presented herein. In this specification and in the claims, the terms "module" and "block" may be used interchangeably to denote an entity configured to perform the operations described.

Note in this specification and in the claims, the denotation of a signal or voltage as being "high" or "low" may refer to such signal or voltage being in a logical "high" or "low" state, which may (but need not) correspond to a "TRUE" (e.g., =1) or "FALSE" (e.g., =0) state for the signal or voltage. It will be appreciated that one of ordinary skill in the art may readily modify the logical conventions described herein, e.g., substitute "high" for "low" and/or "low" for "high," to derive circuitry having functionality substantially equivalent to that described herein. Such alternative exemplary embodiments are contemplated to be within the scope of the present disclosure.

FIG. 1 illustrates a prior art implementation 100 of a low drop-out (LDO) voltage regulator, including start-up circuitry. Note the implementation 100 is shown for illustrative purposes only, and is not meant to limit the scope of the present disclosure.

In FIG. 1, a regulator 101 supplies an output voltage Vout for a load, represented by a load capacitor CL. The regulator 101 includes a pass transistor 110, also known as a power transistor, configured to selectively supply current In from a source (not shown) to a load CL. A resistor network R1/R2 samples the output voltage Vout as Vdiv, and Vdiv is fed to an input of a difference amplifier 120 having gain A. The other input of the difference amplifier 120 is coupled to a reference voltage Vref. The output of difference amplifier 120 is coupled to the gate of the pass transistor 110. In the implementation shown, and for linear regulators in general, the magnitude of the gate-source voltage (e.g., as determined in part by the gate voltage VG) across the pass transistor 110 controls the magnitude of the current In that will be sourced to the load.

Note while the load CL is shown as capacitive in FIG. 1, it will be appreciated that the scope of the disclosure is not limited to only capacitive loads. Furthermore, note that while the pass transistor 110 is shown as an NMOS transistor in FIG. 1, the techniques of the present disclosure may readily be applied to accommodate PMOS pass transistors as well.

It will be appreciated that by action of the feedback loop defined by the elements described hereinabove, the regulator 101 maintains the output voltage Vout at a level determined by the reference voltage Vref. In some implementations, the operation of the regulator 101 can be characterized according to two distinct phases: a start-up phase wherein the output voltage Vout is brought from an initial start-up level to a target level, and a normal phase wherein the output voltage Vout is maintained at the target level(s).

Figure 2:
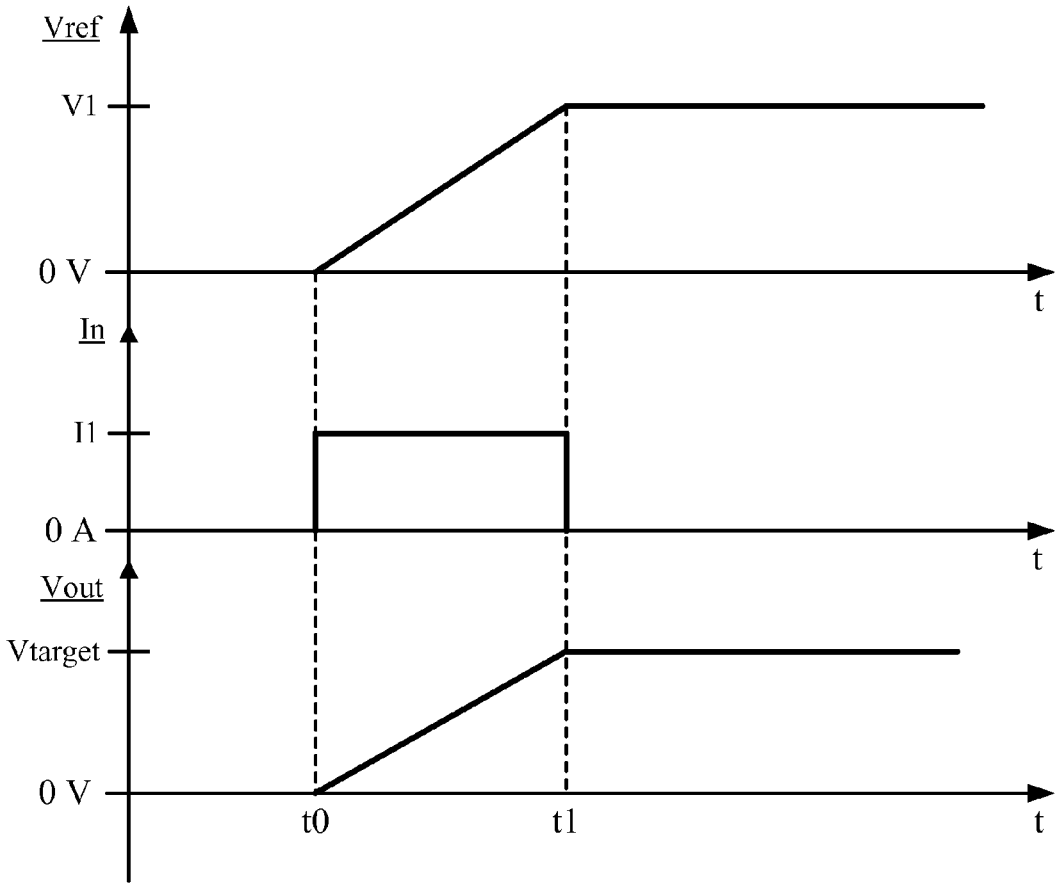
(PRIOR ART) FIG 2
FIG. 2 shows illustrative diagrams for the desired behavior of signals in the regulator during the start-up phase.

In particular, during the start-up phase, the reference voltage Vref may be adjusted so as to bring Vout from an initial level, e.g., 0 Volts, up to the target level in a controlled manner, e.g., within a predetermined period of time. FIG. 2 shows illustrative diagrams for the desired behavior of signals in the regulator 101 during the start-up phase. Note FIG. 2 is shown for illustrative purposes only, and is not meant to limit the scope of the present disclosure.

In FIG. 2, the reference voltage Vref is brought from an initial level of 0 V to a target level of V1 from time t0 to t1 according to a linear ramp profile. By action of the feedback loop of the regulator 101, the output voltage Vout is brought from an initial level of 0 V to a target level of Vtarget, in a manner ideally following the linear ramp profile of Vref during the start-up phase. Note to achieve the linear ramping profile in Vout, the current In drawn by the pass transistor 110, also denoted herein as the "charging current" during the start-up phase, is approximately constant as shown in FIG. 2.

In actual implementations of an LDO regulator, a buffer (not shown in FIG. 1) may be interposed between the difference amplifier 120 and the pass transistor 110. For example, the buffer may be a low-impedance driver with sufficient capacity to drive a potentially large gate capacitance associated with the pass transistor 110. In certain implementations, the gate voltages of transistors associated with the LDO, e.g., voltages such as may be present at the input or output of such buffers, may initially be not well-controlled, and may cause the pass transistor 110 to be suddenly turned on upon start-up, leading to undesirable inrush current.

Figure 3:
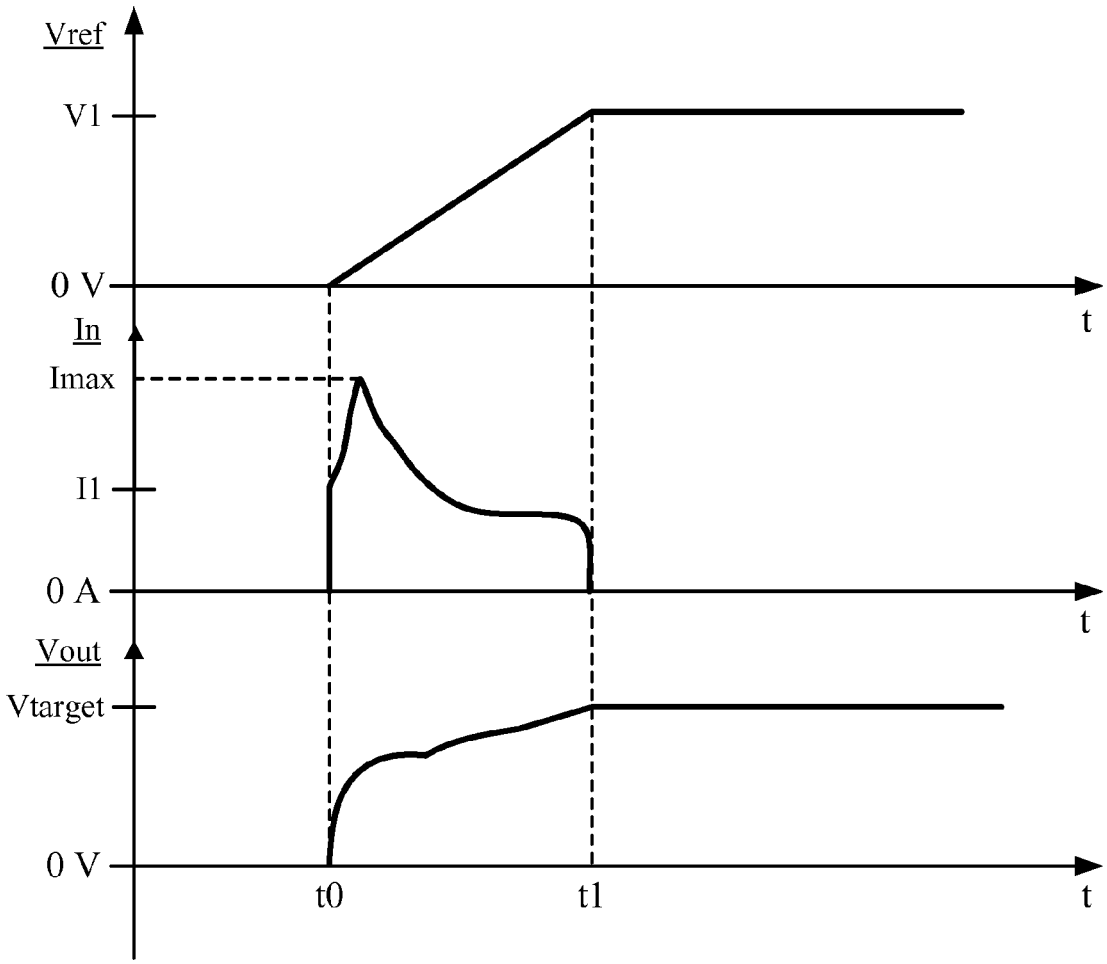
(PRIOR ART) FIG 3
FIG. 3 shows diagrams illustrating the inrush current described hereinabove.

FIG. 3 shows diagrams illustrating the inrush current described hereinabove. Note FIG. 3 is shown for illustrative purposes only, and is not meant to limit the scope of the present disclosure.

In FIG. 3, the reference voltage Vref has a linear ramping profile similar to that described with reference to FIG. 2. However, various non-ideal transient mechanisms in the regulator 101, e.g., undefined gate voltages associated with a buffer driving the pass transistor 110, etc., as described hereinabove, may give rise to a large inrush current at t0, or shortly thereafter. For example, in FIG. 3, In reaches a value as high as Imax, which is much greater than the desired charging current I1, during the initial start-up phase from t0 to t1. Accompanying the transient behavior of In, the output voltage Vout also deviates from the linearly increasing ramping profile shown in FIG. 2.

The inrush current described with reference to FIG. 3 may undesirably disrupt the supply rail, and may adversely affect other circuitry in the device coupled to the supply rail. In view of the limitations of prior art regulators as described hereinabove, it would be desirable to provide techniques for providing a well-controlled charging current for LDO regulators.

Figure 4:
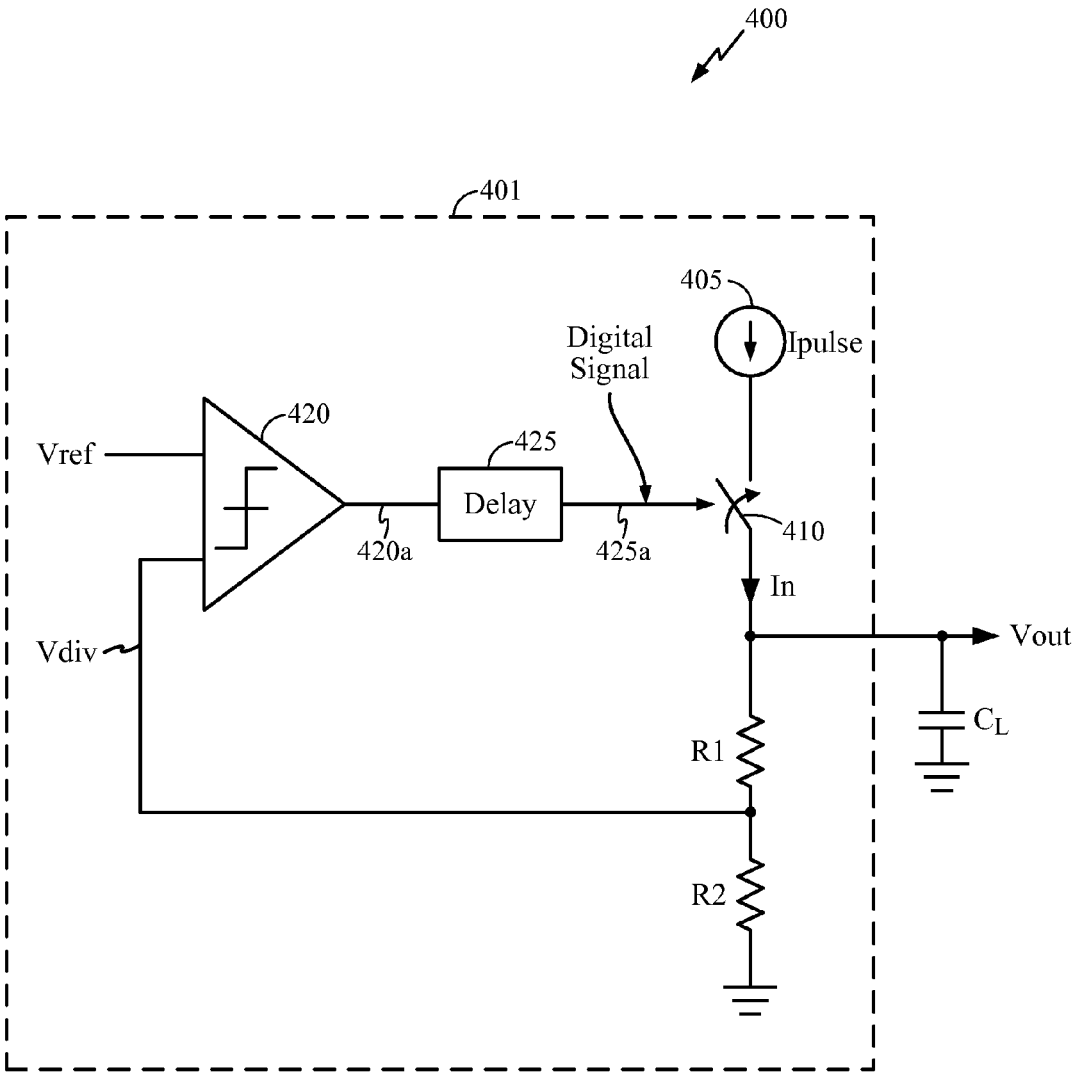
FIG. 4 illustrates an exemplary embodiment of start-up circuitry for an LDO regulator according to the present disclosure.

FIG. 4 illustrates an exemplary embodiment 400 of start-up circuitry for an LDO regulator according to the present disclosure. Note FIG. 4 is shown for illustrative purposes only, and is not meant to limit the scope of the present disclosure to any particular exemplary embodiment.

In FIG. 4, during the start-up phase, a pass switch 410 is controlled by a digital signal 425*a*. In an exemplary embodiment, the pass switch 410 may be, e.g., an NMOS or PMOS pass transistor. The digital signal 425*a* is a delayed version of the output 420*a* of a comparator 420, which outputs a logical "high" signal if Vref is greater than Vdiv, and else a logical "low" signal if Vref is less than Vdiv. In an exemplary embodiment, a logical high for the signal 425*a* closes the pass switch 410, while a logical low for the signal 420*a* opens the pass switch. When the pass transistor 410 is turned on, a current having predetermined amplitude Ipulse (e.g., as supplied by current source 405) will generally be supplied to the load CL.

Note the delay element 425 shown in FIG. 4 need not correspond to an explicitly provided delay element, and may be understood to simply model the effects of any propagation delays present in the system. For example, the delay element 425 may represent the delay introduced by, e.g., the comparator 420, switch 410, etc. In certain exemplary embodiments, the delay element 425 may be an explicitly provided delay element.

In certain exemplary embodiments, the comparator 420 may be implemented as, e.g., a high-gain difference amplifier. In alternative exemplary embodiments, specific and dedicated comparator circuits that are not high gain amplifiers may instead be employed.

Figure 5:
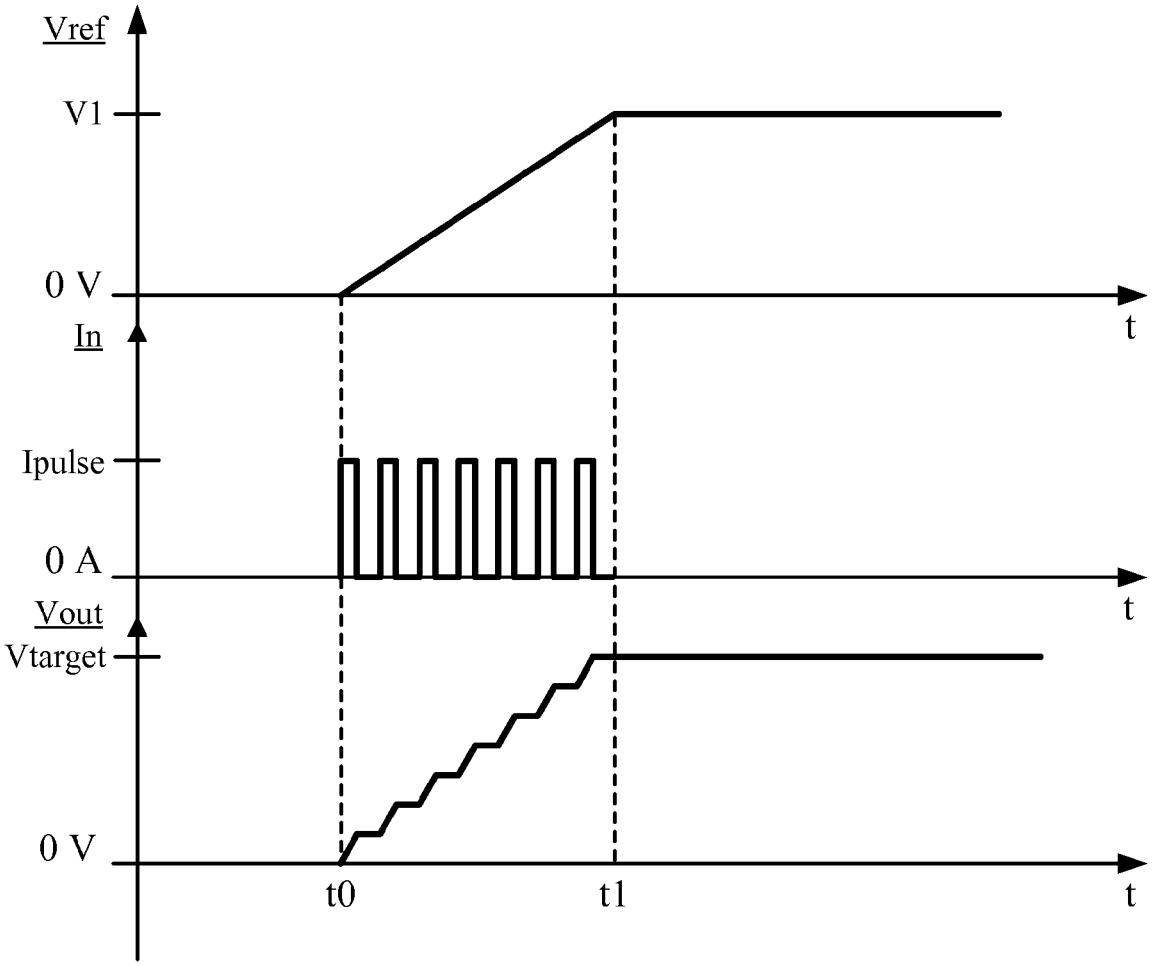
FIG. 5 shows illustrative diagrams for signals in an LDO regulator according to an exemplary embodiment of the present disclosure.

FIG. 5 shows illustrative diagrams for signals in an LDO regulator according to an exemplary embodiment of the present disclosure. Note FIG. 5 is shown for illustrative purposes only, and is not meant to limit the scope of the present disclosure.

In FIG. 5, a series of current pulses, each pulse having a uniform magnitude Ipulse, is sourced through the switch 410 to the load CL during the start-up phase from time t0 to t1. The series of current pulses is generated by digital toggling in the output 420*a* of comparator 420 responsive to the comparison between Vref and Vdiv, as earlier described hereinabove. Responsive to the series of current pulses, the output voltage Vout is seen to rise in increments from an initial voltage of 0 V to the target voltage of Vtarget, i.e., as the load is charged up by the current pulses. It will be appreciated that, as the magnitude of each current pulse is fixed at Ipulse, due to the discrete nature of the switch 410, there will be no undesirable surge or inrush current In significantly exceeding Ipulse during the start-up phase.

In an aspect, the magnitude Ipulse of the charging current should be made sufficiently large to be able to, on average, supply the drawn load current during the start-up phase. For example, assuming that a practical limit of the pulse charging duty cycle is, e.g., 50%, the charging current may be made at least twice the sum of the maximum load current and the average charging current required by the capacitor.

One of ordinary skill in the art will appreciate that the width of and time spacing between current pulses in FIG. 5 are shown for illustrative purposes only, and are not meant to limit the scope of the present disclosure in any manner. Such characteristics will generally be determined by the operating parameters of the system, e.g., the magnitude of Ipulse, the size of the load, etc., as will be readily apparent to one of ordinary skill in the art.

Figure 6:
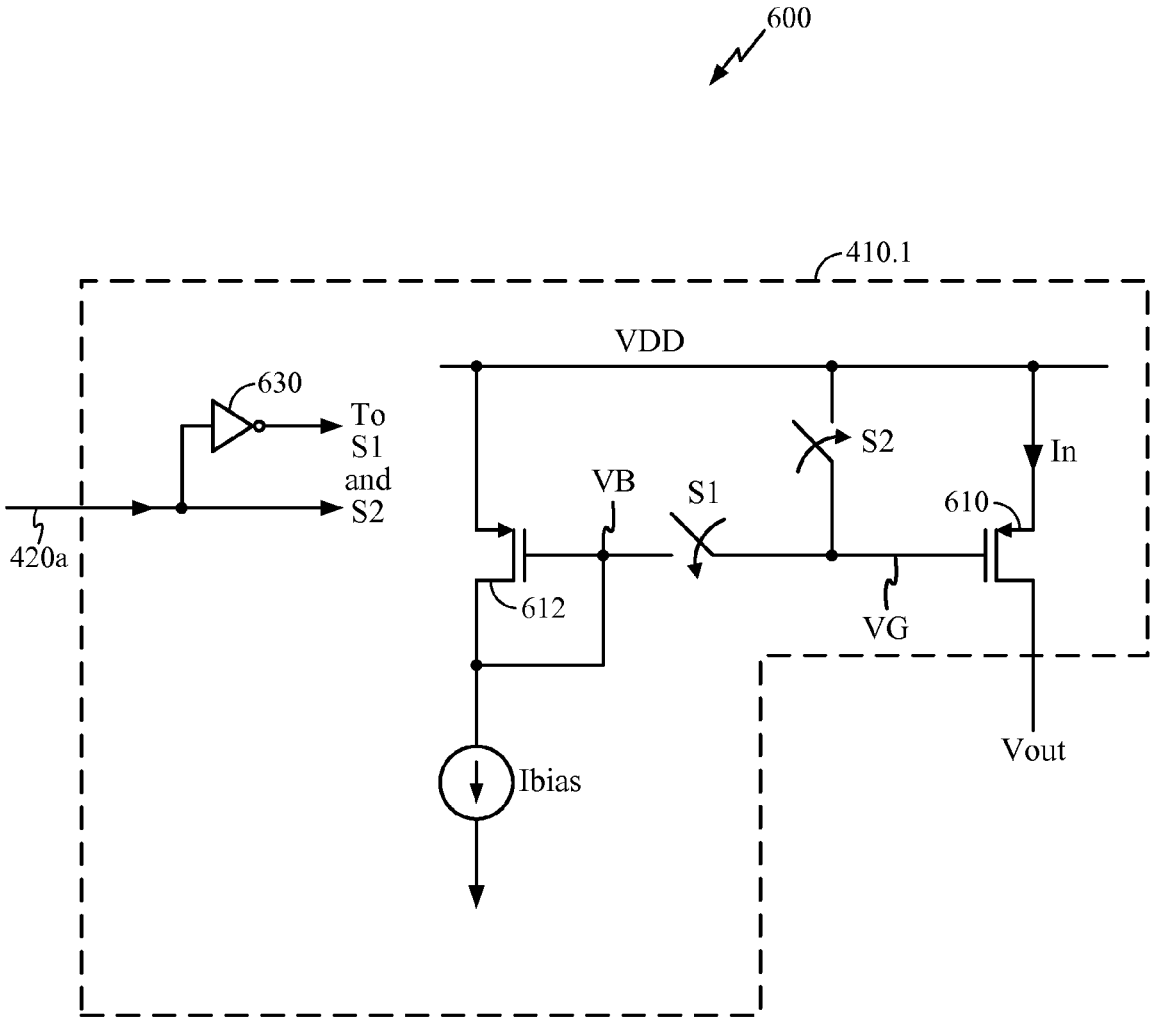
FIG. 6 illustrates an exemplary embodiment of the start-up switching mechanism according to the present disclosure, wherein a PMOS pass transistor is utilized.

FIG. 6 illustrates an exemplary embodiment 600 of the start-up switching mechanism according to the present disclosure, wherein a PMOS pass transistor is utilized. Note FIG. 6 is shown for illustrative purposes only, and is not meant to limit the scope of the present disclosure.

In FIG. 6, an LDO regulator 410.1 includes a PMOS pass transistor 610 configured to selectively supply a current In to the load. Note transistor 610 is shown as a PMOS device, although the techniques disclosed herein may readily be applied to NMOS pass transistors as well, as further described hereinbelow with reference to FIG. 7. The gate of the pass transistor 610 is alternately coupled via switch S2 to VDD, or via switch S1 to the gate voltage VB of diode-coupled transistor 612. Thus when S2 is closed and S1 is open, then pass transistor 610 is turned off. When S1 is closed and S2 is open, then pass transistor 610 is configured to supply a scaled replica of Ibias to the load.

In certain exemplary embodiments, the source of transistor 610 need not be coupled to VDD as shown. For example, the source of transistor 610 may be coupled to a voltage higher than VDD. Furthermore, switch S1 need not couple the gate of transistor 610 to VB as shown, and may instead couple the gate of transistor 610 to, e.g., VSS, in which case no independent bias circuitry would be needed, and the charging current may accordingly be larger than if generated as per FIG. 6. Such alternative exemplary embodiments are contemplated to be within the scope of the present disclosure.

It will be appreciated that as only a discrete number of driving or gate control voltages is allowed for the pass transistor 610 (e.g., either VB or VDD in FIG. 6), the driving voltage for the pass transistor 610 may be characterized as "digital" or "discrete." Furthermore, as VG in this case would be configured to take on only one of a plurality of such discrete voltage levels at any time, the mechanism for generating VG may also be denoted herein as a "discrete voltage source." Note as mentioned hereinabove, providing a discrete driving voltage advantageously prevents excessive surge current from being supplied to the load due to, e.g., an initially undefined gate driving voltage for the pass transistor 610.

In the exemplary embodiment shown, the control signals for switches S1 and S2 may be generated from the output 425*a* of the delay element 425, e.g., as shown in FIG. 4. In an exemplary embodiment, S1 and S2 are configured such that only one switch is closed at any time, e.g., one or more inverting buffers 630 may be utilized to generate the required control signals. By configuring the current In in this manner, signal waveforms such as shown in FIG. 5 described hereinabove may be generated. In particular, the charge current In will correspond to the current pulses having predetermined pulse amplitude Ipulse, e.g., as illustrated in FIG. 5.

Figure 7:
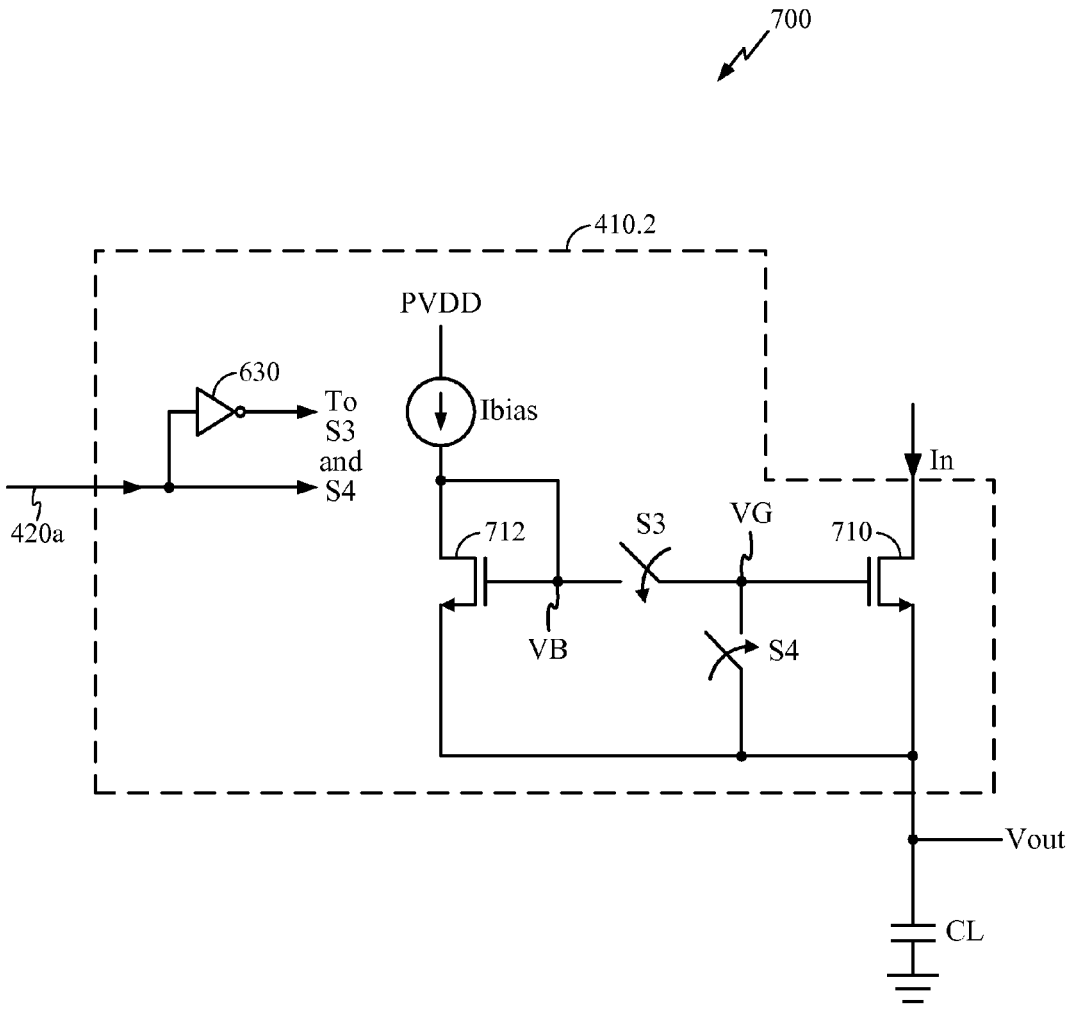
FIG. 7 illustrates an alternative exemplary embodiment according to the present disclosure, wherein an NMOS pass transistor is utilized to supply current to the load.

FIG. 7 illustrates an alternative exemplary embodiment 700 according to the present disclosure, wherein an NMOS pass transistor 710 is utilized to supply current to the load. Note FIG. 7 is shown for illustrative purposes only, and is not meant to limit the scope of the present disclosure.

In FIG. 7, similar to the operation of switches S1 and S2 described with reference to FIG. 6, switches S3 and S4 digitally turn the transistor 710 on and off, respectively. In particular, when S3 is closed and S4 is open, the gate of transistor 710 is coupled to the gate bias voltage VB of transistor 712, which supports a bias current Ibias. Accordingly, the current through transistor 710 will be a scaled replica of Ibias. When S3 is open and S4 is closed, the gate and source of transistor 720 are short-circuited, and transistor 720 is turned off. The control signals for S3 and S4 may be generated as described for S1 and S2 in FIG. 6, e.g., utilizing one or more inverting buffers 630.

In alternative exemplary embodiments (not shown), switch S4 may couple VG to VSS instead of to the source of transistor 710. Furthermore, switch S3 may couple VG to alternative bias voltages generated using techniques not shown. For example, S3 may couple VG to any available high fixed voltage. Such alternative exemplary embodiments are contemplated to be within the scope of the present disclosure.

It will be noted that, in contrast with, e.g., the implementation 600 for the NMOS case, the bias branch current Ibias in implementation 700 flows into the load CL, and thus contributes to charging the load. Note as Ibias is expected to be small and constant, it is not expected to cause a high inrush current problem.

Figure 8:
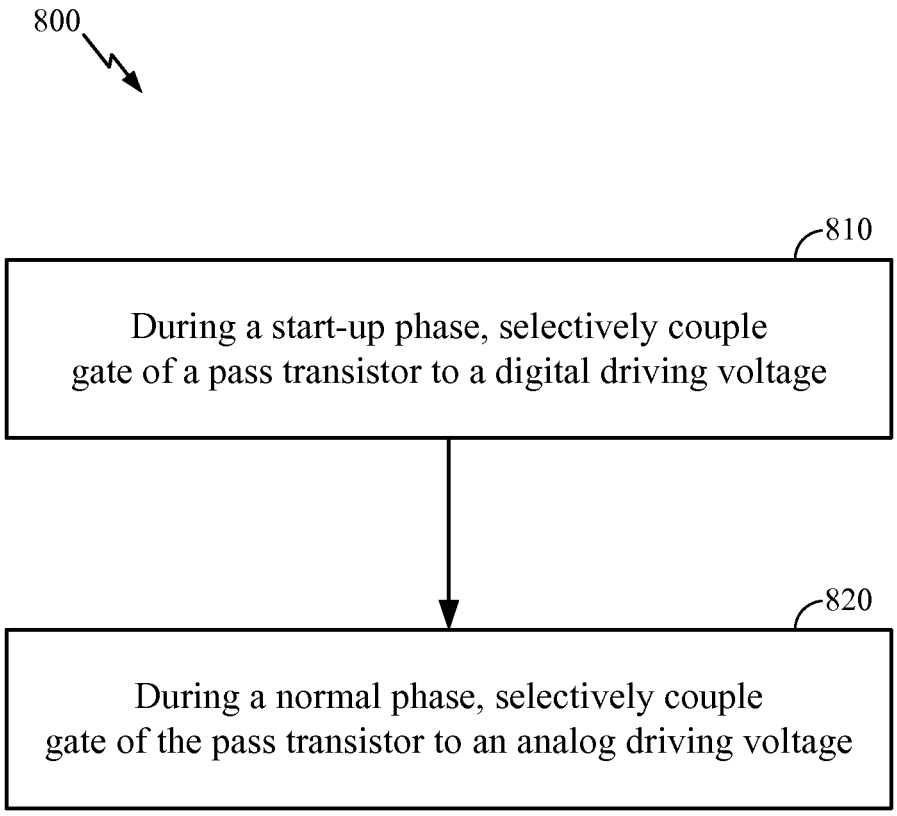
FIG. 8 illustrates an exemplary embodiment of a method for switching the operation phase of the regulator according to the present disclosure.

In an exemplary embodiment, the techniques for providing a digital driving voltage for the pass transistor in an LDO regulator may be applied only during a start-up phase of the regulator, and may be disabled during a normal operation phase of the regulator following the start-up phase. In particular, FIG. 8 illustrates an exemplary embodiment of a method 800 for switching the operating phase of the regulator according to the present disclosure. Note FIG. 8 is shown for illustrative purposes only, and is not meant to limit the scope of the present disclosure to any particular method shown.

In FIG. 8, at block 810, during a start-up phase, the gate of a pass transistor of the LDO regulator is selectively coupled to a digital driving voltage, e.g., generated as described with reference to FIGS. 4-7 hereinabove.

At block 820, during a normal operation phase following the start-up phase, the gate of the pass transistor is selectively coupled to an analog driving voltage, e.g., generated as known in the art for an LDO regulator.

In an exemplary embodiment, the timing for transition from block 810 to block 820 may be determined, e.g., according to a detected level of the output voltage exceeding a predetermined threshold voltage. For example, in an exemplary embodiment, the transition may proceed upon Vdiv in FIG. 4 exceeding a predetermined threshold voltage. Additional techniques such as hysteresis may also be incorporated into the transition timing determination.

Figure 9:
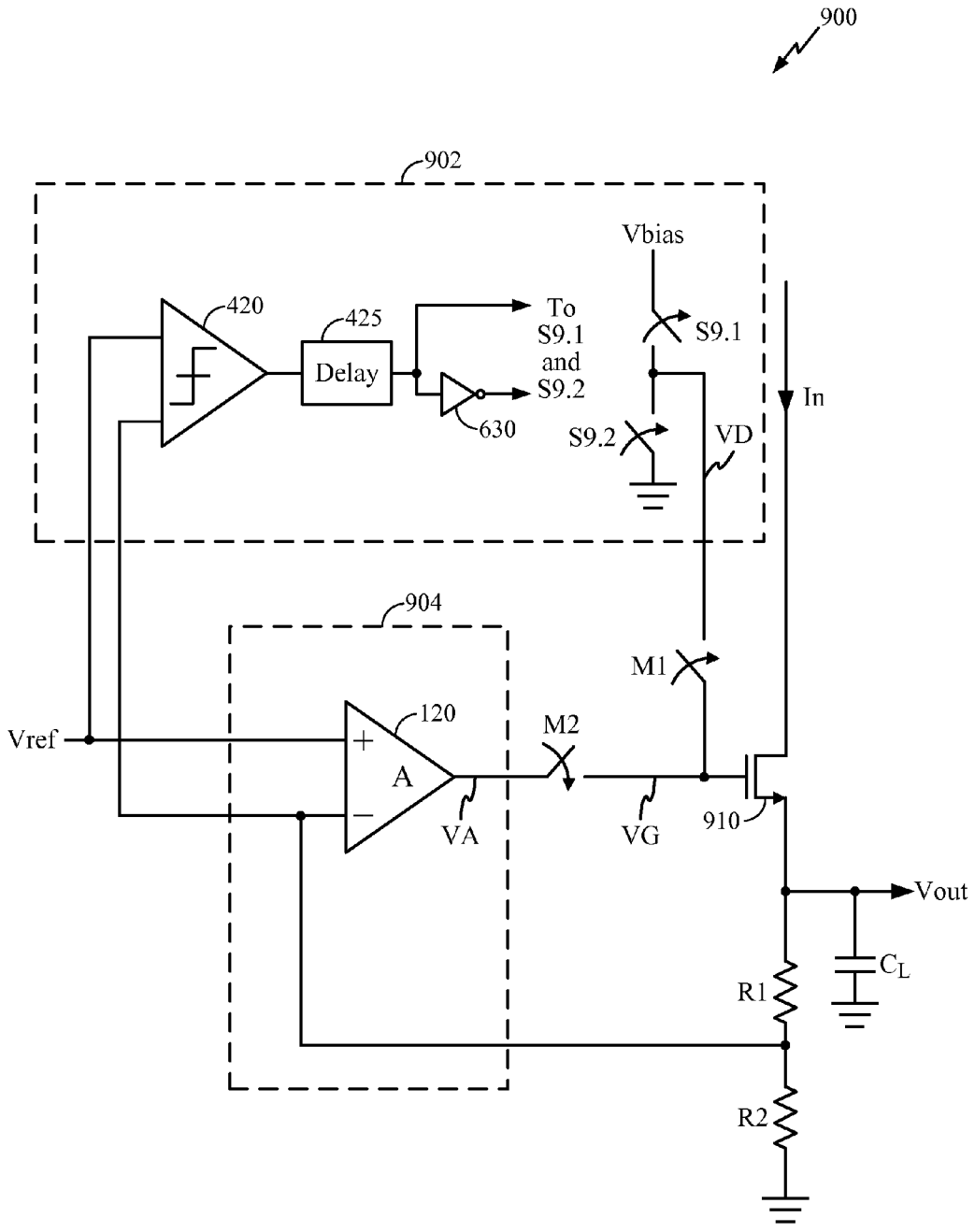
FIG. 9 illustrates an exemplary embodiment of circuitry for implementing the exemplary method described with reference to FIG. 8.

FIG. 9 illustrates an exemplary embodiment of circuitry for implementing the exemplary method 800 described with reference to FIG. 8. Note that FIG. 9 is shown for illustrative purposes only, and is not meant to limit the scope of the present disclosure to any particular implementation of start-up or normal operation circuitry shown.

In FIG. 9, the gate voltage VG of a pass transistor 910 is coupled via switches M1 and M2 either to the output voltage VD of a digital start-up block 902 or to the output voltage VA of an analog normal operation block 904, respectively. In particular, digital start-up block 902 includes digital comparator 420, delay element 425, inverter 630, and switches S9.1 and S9.2, whose operation will be clear in light of the description hereinabove of FIG. 4. When M1 is closed and M2 is open during the start-up phase, the digital start-up block 902 generates an output voltage VD either to turn off the pass transistor 910 or to turn on the transistor 910 to supply a predetermined current Ipulse, e.g., by coupling VG to a predetermined bias voltage Vbias.

In an alternative exemplary embodiment (not shown), switch S9.2 may alternatively couple VD to a voltage other than ground to turn off transistor 910, e.g., switch S9.2 may couple VD to the source of transistor 910. Such alternative exemplary embodiments are contemplated to be within the scope of the present disclosure.

Analog operation block 904 includes an analog error amplifier 120. In particular, when M1 is open and M2 is closed during the normal operation phase, the analog operation block 904 performs normal regulation according to principles known in the art to generate an analog voltage VA for the gate of pass transistor 910.

Note while the exemplary embodiment 900 is shown with the blocks 420 and 120 as separate blocks, in alternative exemplary embodiments, a single high-gain difference amplifier may be shared between the start-up block 902 and the normal operation block 904. Furthermore, note while the exemplary embodiment 900 shows the pass transistor 910 as a single transistor that is shared between the start-up (e.g., with discrete gate voltage) and normal operation (e.g., with analog control voltage) modes, alternative exemplary embodiments (not shown) may provide a separate pass transistor for each mode. For example, in such an alternative exemplary embodiment, a first pass transistor having a discrete gate control voltage may be provided for the start-up mode, and a second pass transistor having an analog gate control voltage may be provided for the normal operation mode, and switches may be provided to select which pass transistor is enabled to supply current to the load at any given time. Such alternative exemplary embodiments are contemplated to be within the scope of the present disclosure.

Figure 10:
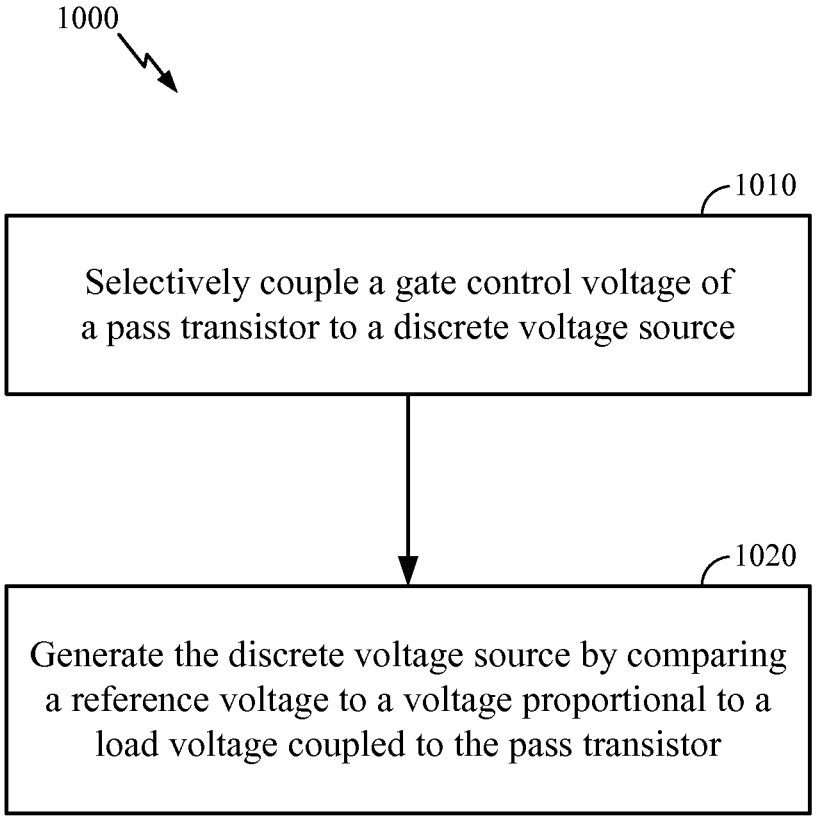
FIG. 10 illustrates an exemplary embodiment of a method according to the present disclosure.

FIG. 10 illustrates an exemplary embodiment of a method according to the present disclosure. Note the method is shown for illustrative purposes only, and is not meant to limit the scope of the present disclosure.

In FIG. 10, at block 1010, a gate control voltage of a pass transistor is selectively coupled to a discrete voltage source. In an exemplary embodiment, the discrete voltage source may correspond to, e.g., a voltage source generating first and second levels. For example, the first level may turn on the pass transistor, and the second level may turn off the pass transistor, as described hereinabove with reference to FIGS. 4-7.

At block 1020, the discrete voltage source is generated by comparing a reference voltage to a voltage proportional to a load voltage coupled to the pass transistor.

In this specification and in the claims, it will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Furthermore, when an element is referred to as being "electrically coupled" to another element, it denotes that a path of low resistance is present between such elements, while when an element is referred to as being simply "coupled" to another element, there may or may not be a path of low resistance between such elements.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill in the art would further appreciate that the various illustrative logical blocks, modules, circuits, and algorithm steps described in connection with the exemplary aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary aspects of the invention.

The various illustrative logical blocks, modules, and circuits described in connection with the exemplary aspects disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the exemplary aspects disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary aspects, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and Blu-Ray disc where disks usually reproduce data magnetically, while discs reproduce data optically with lasers. Combinations of the above should also be included within the scope of computer-readable media.

The previous description of the disclosed exemplary aspects is provided to enable any person skilled in the art to make or use the invention. Various modifications to these exemplary aspects will be readily apparent to those skilled in the art, and the generic principles defined herein may be applied to other exemplary aspects without departing from the spirit or scope of the invention. Thus, the present disclosure is not intended to be limited to the exemplary aspects shown herein but is to be accorded the widest scope consistent with the principles and novel features disclosed herein.

The invention claimed is:

1. An apparatus comprising:

a pass transistor configured to receive a gate control voltage, wherein the gate control voltage is selectively electrically coupled and electrically decoupled to a discrete voltage source, wherein the discrete voltage source comprises a start-up circuitry configured to generate discrete voltages, the start-up circuitry comprising a comparator, wherein a first input of the comparator is coupled to a reference voltage, and a second input of the comparator is coupled to a voltage proportional to a load voltage coupled to the pass transistor, and wherein the start-up circuitry generates the discrete voltages in a start-up phase, and the pass transistor incrementally raises the load voltage from an initial voltage to a target voltage in response to the discrete voltages in the start-up phase, wherein the pass transistor comprises one of a PMOS transistor and an NMOS transistor, a gate of the pass transistor coupled to:

a first switch coupled to a source of the one of the PMOS transistor and the NMOS transistor, and a second switch coupled to a reference bias voltage.

2. The apparatus of claim 1, wherein the discrete voltage source is configured to output no more than two voltage levels, the two levels comprising a low voltage and a high voltage.

3. The apparatus of claim 1, wherein the gate control voltage is further selectively coupled to an analog driving voltage when not electrically coupled to the discrete voltage source, the apparatus further comprising linear regulator circuitry to generate the analog driving voltage.

4. The apparatus of claim 3, further comprising circuitry configured to determine when to select the discrete voltage source or the analog driving voltage.

5. The apparatus of claim 1, the start-up circuitry comprising a delay element coupling an output of the comparator to the gate control voltage.

6. The apparatus of claim 5, the delay element comprises a buffer.

7. The apparatus of claim 1, wherein the pass transistor comprises the PMOS transistor.

8. The apparatus of claim 7, wherein the reference bias voltage comprising a gate voltage of a reference PMOS transistor coupled to a reference current.

9. The apparatus of claim 1, wherein the pass transistor comprises the NMOS transistor.

10. The apparatus of claim 9, wherein the reference bias voltage comprises a gate voltage of a reference NMOS transistor coupled to a reference current, wherein a source of the reference NMOS transistor is coupled to the source of the pass transistor.

11. The apparatus of claim 1, wherein the pass transistor outputs current pulses in response to the discrete voltages.

12. The apparatus of claim 11, wherein the current pulses correspond to a reference current.

13. An apparatus comprising:

means for selectively electrically coupling and electrically decoupling a gate control voltage received by a pass transistor to a discrete voltage source, the pass transistor comprising one of a PMOS transistor and an NMOS transistor, a gate of the pass transistor coupled to a first switch coupled to a source of the one of the PMOS transistor and the NMOS transistor, and a second switch coupled to a reference bias voltage; and means for generating discrete voltages by comparing a reference voltage to a voltage proportional to a load voltage coupled to the pass transistor in a start-up phase, wherein the pass transistor outputs a series of current pulses of a uniform magnitude in response to the discrete voltages in the start-up phase, a duty cycle of the current pulses corresponding to a high level and a low level of the discrete voltages; and the pass transistor incrementally raises the load voltage from an initial voltage to a target voltage in response to the discrete voltages in the start-up phase.

14. The apparatus of claim 13, the means for generating the discrete voltages further comprising:

means for coupling a first switch to a first level when the reference voltage is greater than the voltage proportional to the load voltage; and means for coupling a second switch to a second level when the reference voltage is not greater than the voltage proportional to the load voltage.

15. The apparatus of claim 13, further comprising means for selectively coupling the gate control voltage to an analog control voltage when not coupled to the discrete voltage source.

16. The apparatus of claim 15, further comprising means for switching between the discrete voltage source and the analog control voltage in response to detecting the load voltage exceeding a threshold level.

17. The apparatus of claim 13, the means for generating the discrete voltages further comprising means for delaying a result of the comparing by a predetermined delay.

18. A method comprising:

selectively electrically coupling and electrically decoupling a gate control voltage received by a pass transistor to a discrete voltage source, the pass transistor comprising one of a PMOS transistor and an NMOS transistor, a gate of the pass transistor coupled to a first switch coupled to a source of the one of the PMOS transistor and the NMOS transistor, and a second switch coupled to a reference bias voltage;

generating discrete voltages by comparing a reference voltage to a voltage proportional to a load voltage coupled to the pass transistor in a start-up phase;

outputting a series of current pulses of a uniform magnitude, by the pass transistor, in response to the discrete voltages in the start-up phase, a duty cycle of the current pulses corresponding to a high level and a low level of the discrete voltages; and raising incrementally by the pass transistor the load voltage from an initial voltage to a target voltage in response to the discrete voltages in the start-up phase.

19. The method of claim 18, wherein the generating the discrete voltages further comprises:

coupling a first switch to a first level when the reference voltage is greater than the voltage proportional to the load voltage; and coupling a second switch to a second level when the reference voltage is not greater than the voltage proportional to the load voltage.

20. The method of claim 18, further comprising selectively coupling the gate control voltage to an analog control voltage when not coupled to the discrete voltage source.

21. The method of claim 20, further comprising switching between the discrete voltage source and the analog control voltage in response to detecting the load voltage exceeding a threshold level.

22. The method of claim 18, wherein the generating the discrete voltages further comprises delaying a result of the comparing by a predetermined delay.

* * * * *